US007766426B2

(12) United States Patent
Meidan

(10) Patent No.: US 7,766,426 B2
(45) Date of Patent: Aug. 3, 2010

(54) TILT CONTROLS FOR CHAIRS

(75) Inventor: Daniel Meidan, Thornhill (CA)

(73) Assignee: Ram Machines (1990) Ltd., Concord, Ontario (CA)

( * ) Notice: Subject to any disclaimer, the term of this patent is extended or adjusted under 35 U.S.C. 154(b) by 221 days.

(21) Appl. No.: 11/892,825

(22) Filed: Aug. 28, 2007

(65) Prior Publication Data

US 2008/0054700 A1 Mar. 6, 2008

Related U.S. Application Data

(60) Provisional application No. 60/840,714, filed on Aug. 29, 2006.

(51) Int. Cl.
*A47C 3/00* (2006.01)

(52) U.S. Cl. ..... 297/303.4; 297/302.7; 297/313; 297/327

(58) Field of Classification Search ..... 297/302.4, 297/302.5, 302.6, 302.7, 303.4, 313, 327, 297/328

See application file for complete search history.

(56) References Cited

U.S. PATENT DOCUMENTS

| | | | | | |
|---|---|---|---|---|---|
| 1,926,259 | A * | 9/1933 | Bitzenburger | ..... | 297/301.4 |
| 3,434,756 | A * | 3/1969 | Walkinshaw | ..... | 297/301.4 |
| 3,480,249 | A * | 11/1969 | Lie | ..... | 248/608 |
| 4,384,741 | A * | 5/1983 | Flum et al. | ..... | 297/300.5 |
| 4,763,950 | A * | 8/1988 | Tobler | ..... | 297/300.3 |
| 4,830,431 | A * | 5/1989 | Inoue | ..... | 297/300.5 |
| 5,207,479 | A * | 5/1993 | Wickman et al. | ..... | 297/303.4 |
| 5,417,474 | A * | 5/1995 | Golynsky | ..... | 297/302.1 |
| 5,810,439 | A * | 9/1998 | Roslund, Jr. | ..... | 297/300.4 |
| 6,033,020 | A * | 3/2000 | Ito | ..... | 297/302.4 |
| 6,139,103 | A * | 10/2000 | Hybarger et al. | ..... | 297/300.5 |
| 6,378,943 | B1 * | 4/2002 | Beggs et al. | ..... | 297/325 |
| 6,588,843 | B1 * | 7/2003 | Ebenstein | ..... | 297/300.1 |
| 6,840,578 | B1 * | 1/2005 | Su | ..... | 297/302.3 |
| 6,921,134 | B1 * | 7/2005 | Hong | ..... | 297/301.7 |
| 6,957,862 | B2 * | 10/2005 | Chen | ..... | 297/300.1 |
| 6,957,864 | B2 * | 10/2005 | Chen | ..... | 297/302.5 |
| 7,293,832 | B2 * | 11/2007 | Huang | ..... | 297/300.8 |
| 7,316,453 | B2 * | 1/2008 | Dobkin et al. | ..... | 297/303.4 |
| 2001/0013569 | A1 * | 8/2001 | Donati | ..... | 248/372.1 |

* cited by examiner

*Primary Examiner*—Laurie K Cranmer
(74) *Attorney, Agent, or Firm*—Bereskin & Parr LLP/S.E.N.C.R.L., s.r.l.

(57) ABSTRACT

A tilt mechanism for a chair includes rotary stop means defining a plurality of selectable tilted positions of the chair seat/back. In another aspect, an anti kick-back feature is provided based. The mechanism includes upper and lower housing parts and a cushioning spring that normally maintains the parts in a rest position with respect to one another while allowing the mechanism to tilt. A further aspect of the invention provides an improved spring tension control that allows the spring to be installed and removed in a fully relaxed condition so that no special tools are required.

10 Claims, 15 Drawing Sheets

SEAT AT 3.5 DEG BACKWARDS

FIG 11
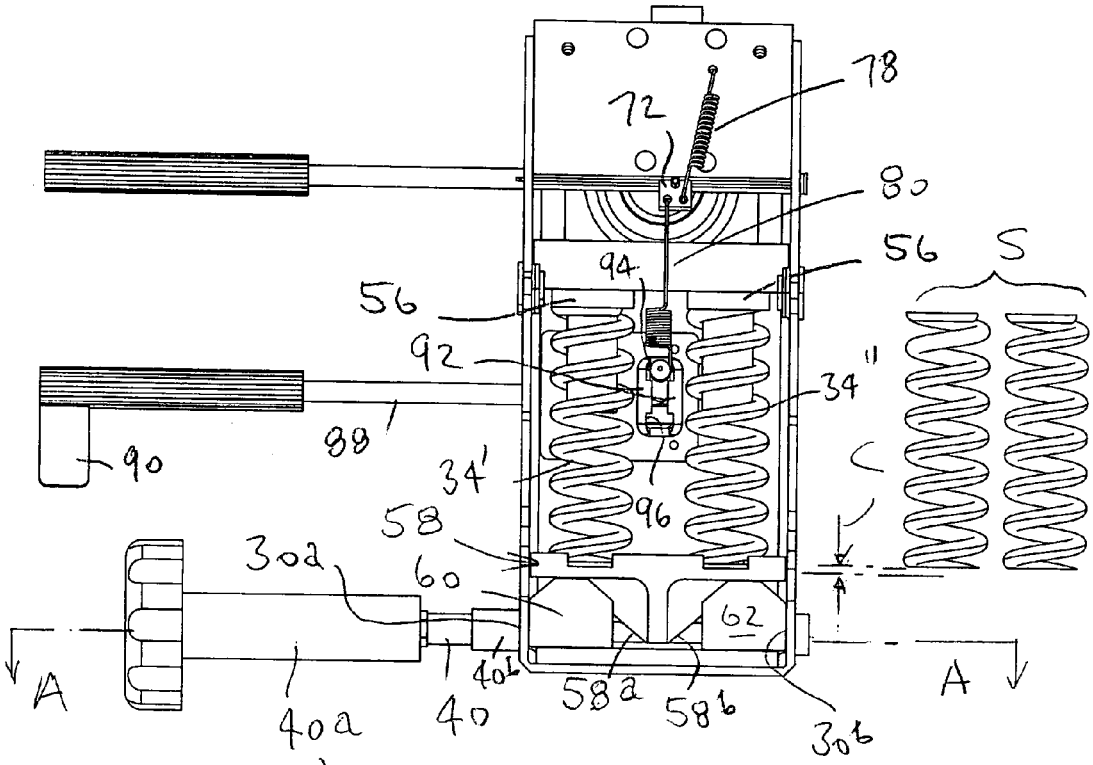
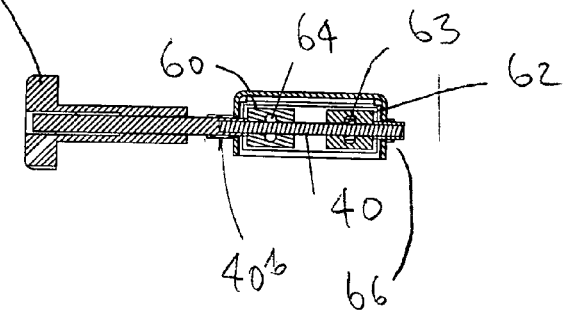
FIG 12

TILT CONTROLS FOR CHAIRS

FIELD OF THE INVENTION

The invention relates generally to tilt mechanisms for chairs such as office chairs.

BACKGROUND OF THE INVENTION

A typical office chair includes a seat/back assembly which is coupled to a chair base by a mechanism that allows controlled tilting of the seat/back assembly with respect to the base. The base usually has an upright post which carries a lower, stationary housing part of the tilt mechanism. Pivoted to the stationary housing part is an upper housing part that carries the seat/back assembly. The back may or may not be movable with respect to the seat. A spring extends between the two housing parts of the tilt mechanism and normally maintains the parts in a rest position with respect to one another. When a person sitting on the chair leans back, the upper housing part tilts with respect to the lower housing part and the spring is compressed, cushioning the tilting movement. The spring tension is adjustable to vary the degree of cushioning.

CA 2,446,654 discloses a chair spring tension control having a side operated actuator that is accessible to a person seated on a chair fitted with the control. CA 2,301,933 discloses a chair seat tilt lock mechanism.

SUMMARY OF THE INVENTION

An object of the present invention is to provide a number of improvements in tilt mechanisms for chairs.

A mechanism in accordance with the present invention includes upper and lower housing parts adapted to be coupled respectively to a chair seat/back assembly and to a chair base, the parts being pivoted together for movement with respect to one another to permit tilting of the seat/back assembly with respect to the base in use. A compression spring is coupled between the upper and lower housing parts so as to normally maintain the parts in a rest position and to be compressed when the upper housing part tilts with respect to the lower housing part in use. The tilt mechanism includes a tension control for the compression spring between the housing parts, comprising co-operating wedges having confronting sliding surfaces so that movement of the wedges in one direction with respect to one another increasing spring tension while movement in the opposite direction reduces spring tension. In a minimum position, the spring is fully relaxed so that it can be removed and installed by hand, without the need for any special tools.

Stop means may be provided between the upper and lower housing parts and defines the rest position of those parts. The stop means includes a plurality of stop surfaces and is moveable to bring different ones of those surfaces selectively into an operative position between the housing parts, defining respectively different angular positions of the housing parts with respect to one another. The mechanism also includes an operator controlled actuator for moving the stop means.

The stop means may be a slide profiled to define the plurality of stop surfaces at positions spaced along the slide or a rotary stop with stop surfaces at different radial positions with respect to an axis about which the stop can be turned.

In the case of a rotary stop, the actuator may be a simple rotary shaft that extends transversely of the mechanism so as to project outwardly to one side of the seat of the chair when the mechanism is installed. A handle is provided on the outer end of the shaft, so that the shaft can conveniently be turned by a person seated on the chair, turning the rotary stop means to different positions. Conveniently, the stop means comprise a pair of rotary cam-like structures, one at each side of the tilt mechanism. The shaft is carried by the upper housing part and the cam-like structures, one at each side, rest on respective stop surfaces on the lower housing part.

The stop means provides a convenient way of defining different rest positions of the tilt mechanism. For example, in a typical mechanism, the cam-like structures are profiled to define three stop surfaces at different radial positions with respect to the shaft, one defining a 1.5 degree forward tilt, another defining a 6.5 degree forward tilt and the third defining a 3.5 degree backward tilt.

Of course, the number of stop surfaces and the degree of tilt can vary.

An anti kick-back feature may be provided; that is, a feature that prevents release of the mechanism in such a way as to allow uncontrolled return of the housing parts to their rest position under the effect of the compression spring. For example, if a chair has been set at a particular tilt using a locking device and the device is released, if there is no anti kick-back control, the seat back will be propelled rapidly forward and possibly even hit the user of the chair. If the chair is unoccupied, this can cause the chair to "kick" in an uncontrolled fashion, and possibly even fall over.

The tilt mechanism include anti kick-back control means comprising a tongue carried by one of the housing parts and a rack carried by the other housing part and having teeth for receiving the tongue. The rack is curved about a pivot axis between the upper and lower housing parts of the chair and the tongue is moveable between extended and retracted positions by a tension member in one direction and a tension spring that is extended for biasing the tongue to its extended position in engagement with the rack.

The compression spring between the housing parts provides a biasing force that causes the tongue to bind in the tooth of the rack in which it is received and prevents retraction of the tongue until a force counter to the biasing force is applied to the housing parts.

In a practical situation in which the tilt mechanism is installed in a chair, this counter force will be provided by a person who leans back in the chair against the force of the compression spring to so to speak "unbind" the tongue. In other words, by leaning back in the chair, the user moves the housing parts to a position in which the tongue is free to retract. Since the user is seated in the chair at the time and pushing back on the chair back, the user's body effectively controls return movement of the housing parts under the effect of the compression spring and there is no "kick" or uncontrolled movement.

BRIEF DESCRIPTION OF THE DRAWINGS

In order that the invention may be more clearly understood, reference will now be made to the accompanying drawings which illustrate preferred embodiments of the aspects of the invention. In the drawings:

FIG. 11 is a partial view similar to FIG. 10, in which the springs are shown separate from the chair control, prior to installation;

FIG. 12 is a sectional view on line A-A in FIG. 11;

DETAILED DESCRIPTION OF THE INVENTION

Figure 1:
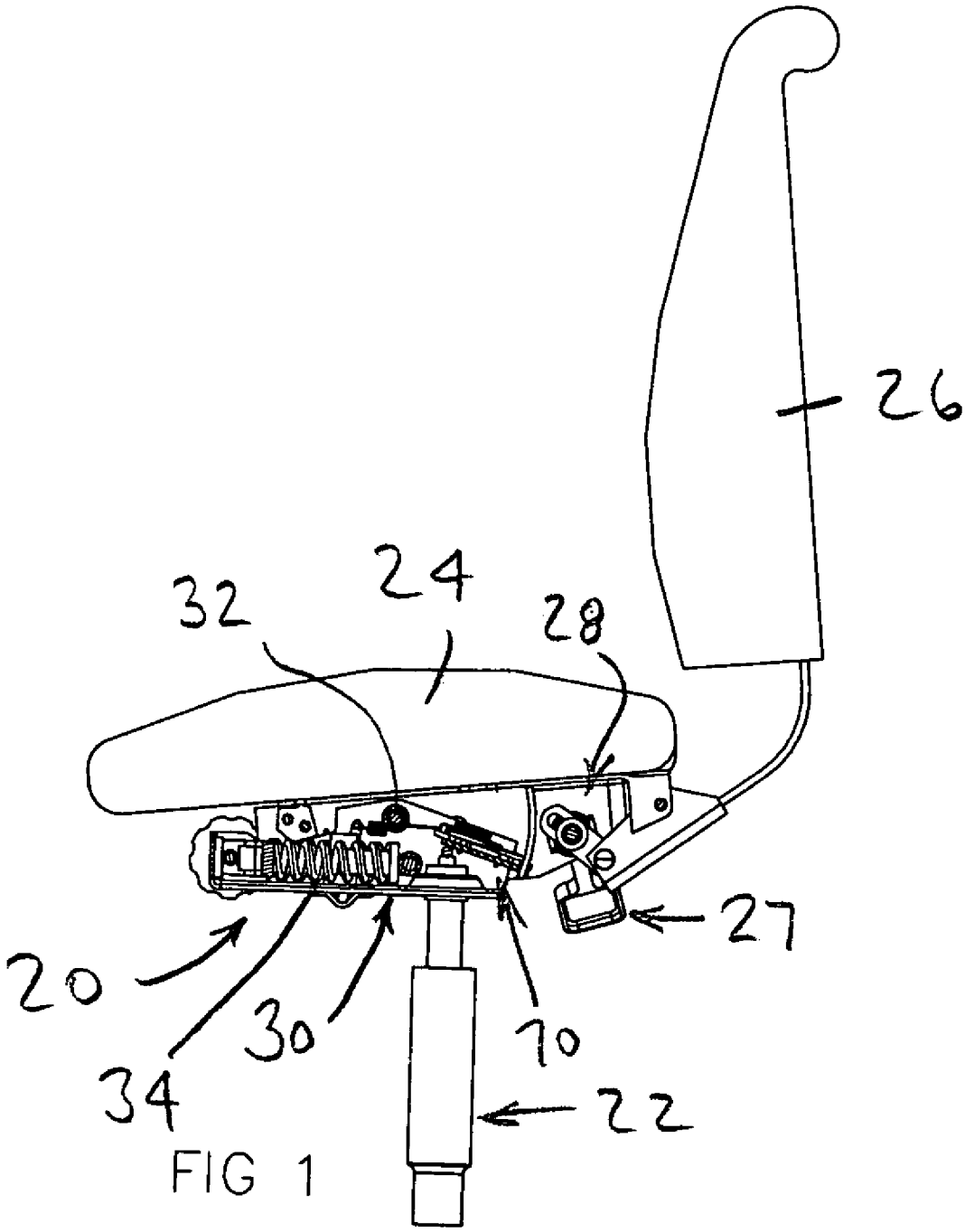
FIG. 1 is a side elevational view of a typical office chair fitted with a chair control in accordance with the invention, with the control shown partly in cross-section.

Referring first to FIG. 1, a tilt mechanism in accordance with the invention is shown generally at 20 installed between a typical chair base 22 and a chair seat and back assembly including a seat 24 and a back 26. The seat 24 and back 26 may be in fixed angular relationship with respect to one another. However, reference numeral 27 denotes a known clutch mechanism which allows the back to be tilted and locked with respect to the seat. Since the mechanism is known it will not be described.

The tilt mechanism 20 includes an upper housing part 28 and a lower housing part 30 coupled together for pivotal movement about a transverse pivot axis indicated at 32 in FIG. 1. The upper housing part 28 carries the seat/back assembly 24, 26. Assuming the tilt mechanism is not locked, when a person sitting on the seat 24 pushes against the back 26, the upper housing part moves in the clockwise direction about pivot axis 32 considering the mechanism as seen in FIG. 1.

Figure 2:
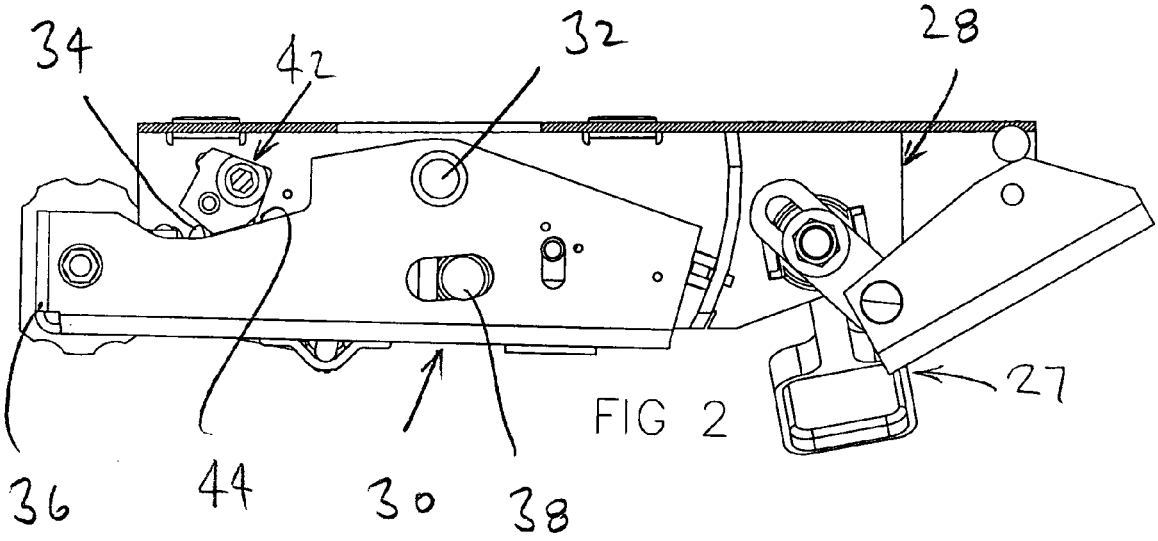
FIGS. 2 to 5 are general assembly drawings showing respectively a side elevational view; a perspective view; a plan view; and an end elevational view of a chair tilt mechanism in accordance with the present invention.
Figure 3:
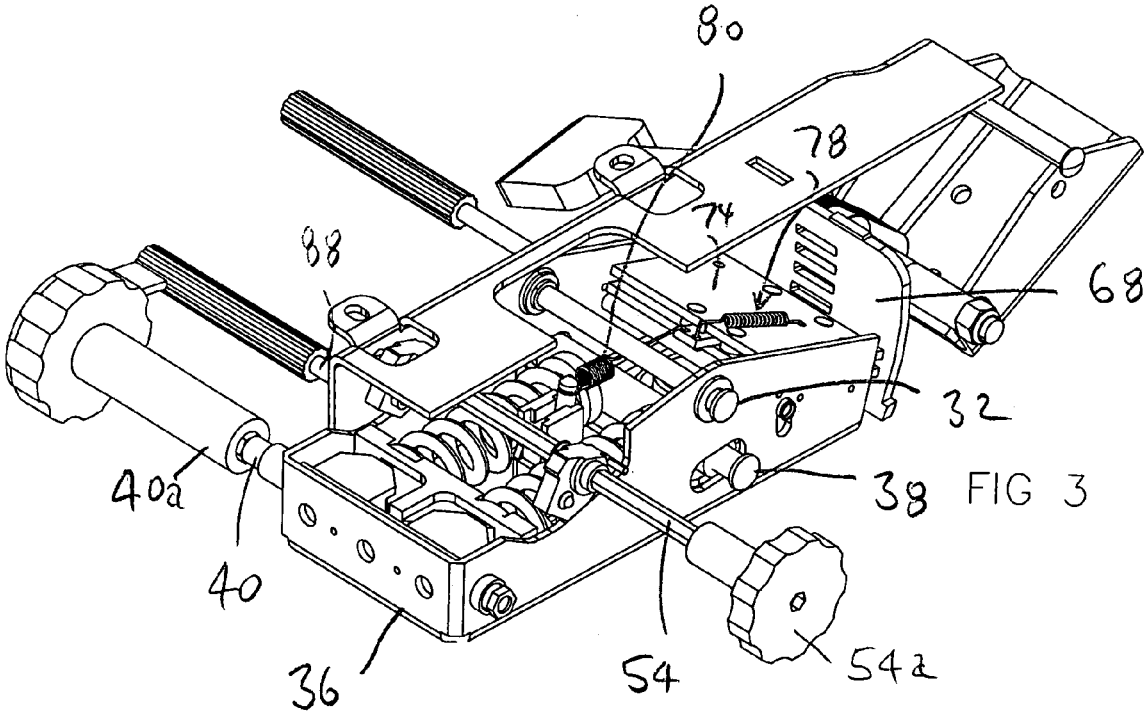
Figure 4:
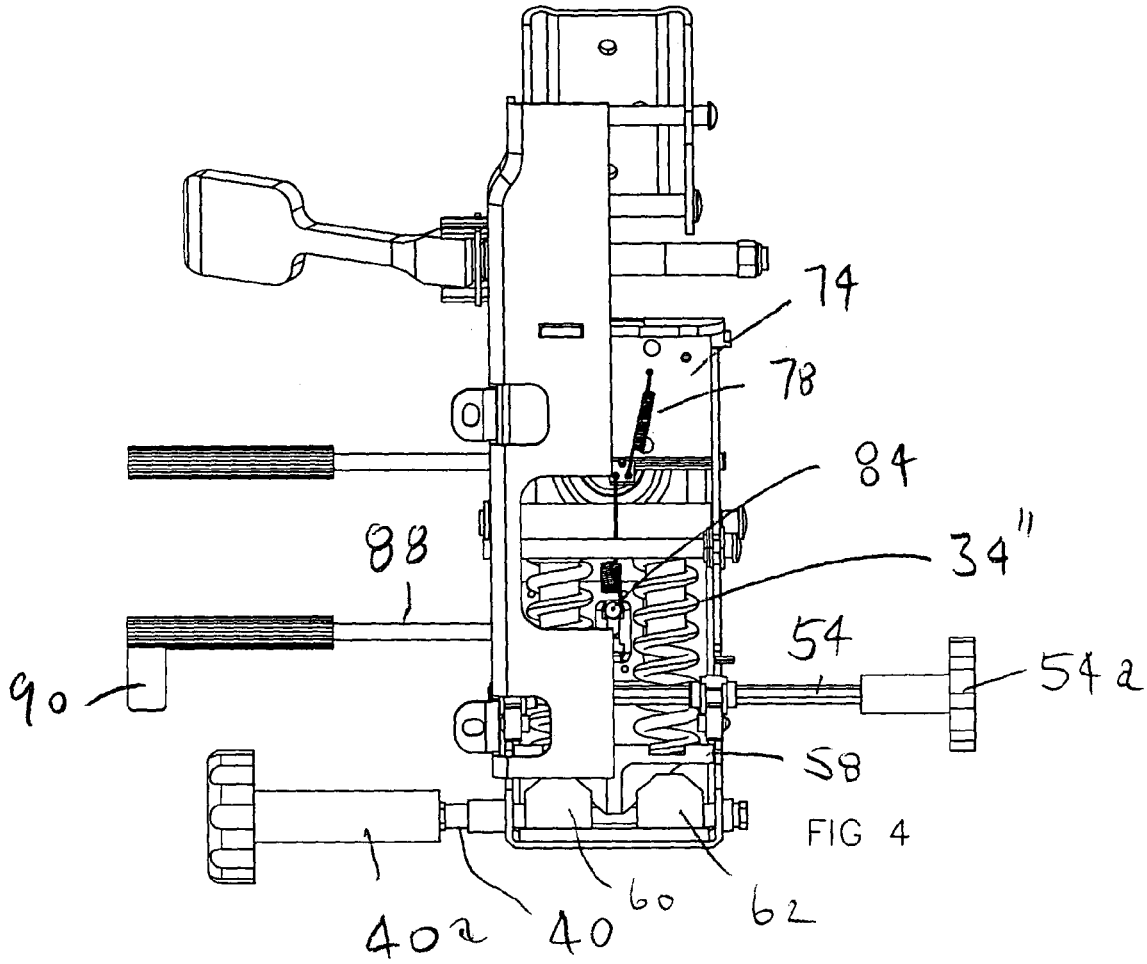
Figure 5:
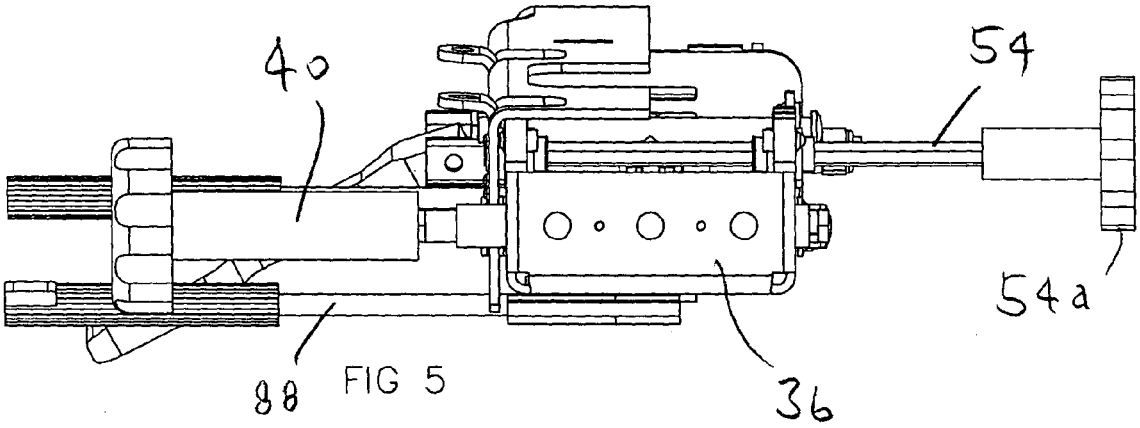

FIG. 2 shows the tilt mechanism 20 of FIG. 1 separate from the chair components. As indicated previously, FIGS. 2 to 5 are general assembly drawings and as such include components not directly relevant to the present invention. Accordingly, only the principal components of the mechanism will be described.

It is important to note that the mechanism includes one or more compression springs 34 coupled between the upper and lower housing parts so as to normally maintain those parts in a rest position and which is compressed when the upper housing part 28 tilts with respect to the lower housing part 30 in use. In FIG. 2, for example, the spring is mostly hidden but from FIGS. 1 and 1*a* it can be seen that the spring effectively acts between one end 36 of the lower housing part 30 and a transverse pin 38 that extends between the side walls of the upper housing part 28 and is received in elongate openings in side walls of the lower housing part 30. Accordingly, if the upper housing part 28 is rotated clockwise from the position shown about pivot pin 32, pin 38 moves to the left and compresses the spring.

A tension adjustment mechanism is provided for the spring and comprises a wedge arrangement somewhat similar to that disclosed in Canadian Patent Application No. 2,446,654 referred to previously, but incorporating improvements to be described. The mechanism is actuated by a shaft indicated at 40 in FIGS. 3 and 4 which projects laterally below the seat of the chair and which has a handle 40*a* that can conveniently be turned by a person seated on the chair, to adjust spring tension.

Figure 1A:
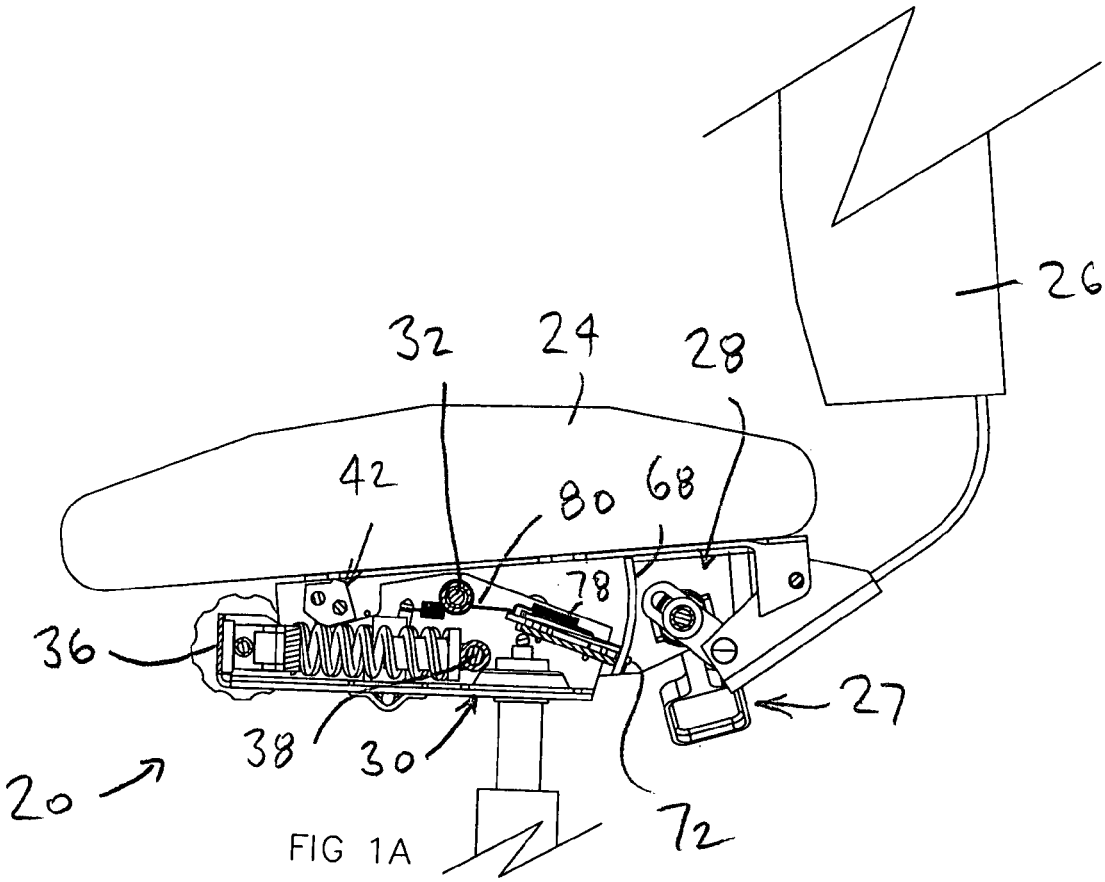
FIG. 1*a* is an enlargement of the chair control of FIG. 1.
Figure 6:
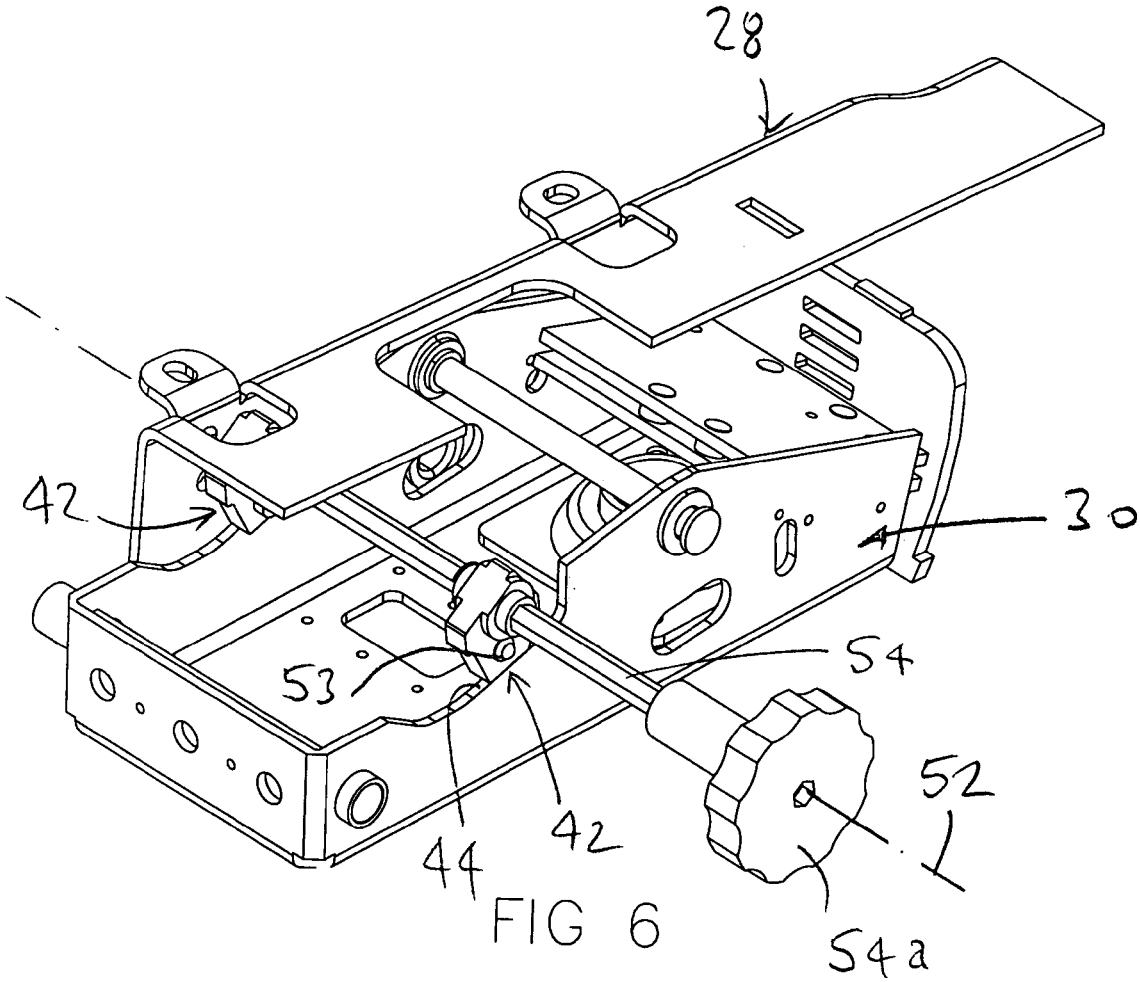
FIG. 6 is a view similar to FIG. 3 but with parts removed so as to illustrate only the forward tilt stop mechanism.
Figure 7:
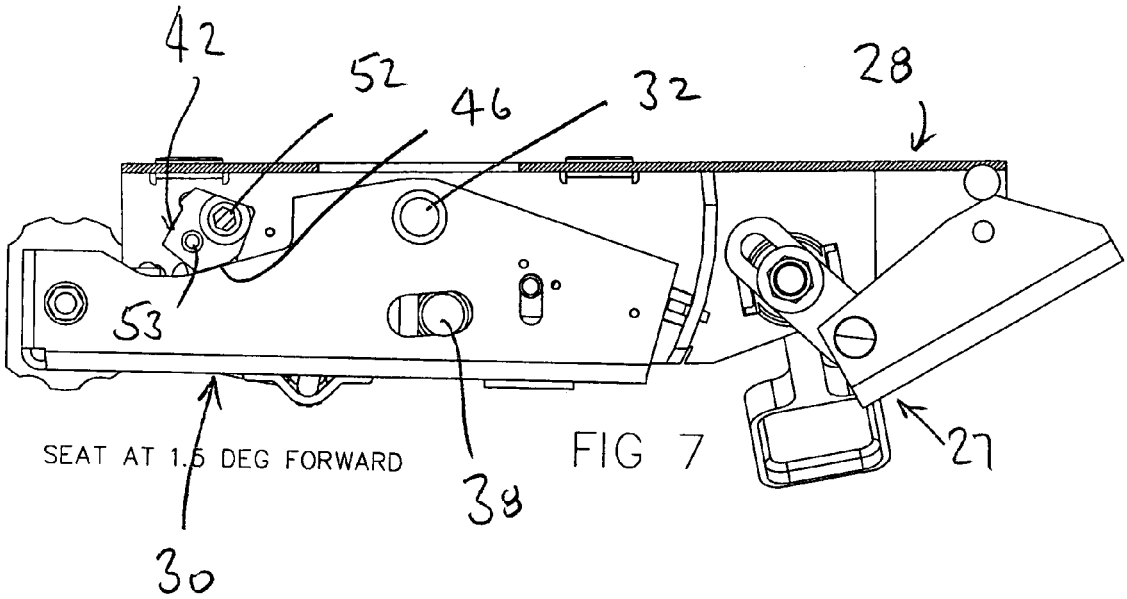
FIGS. 7, 8 and 9 are side elevational views corresponding to FIG. 6 illustrating three different stop positions of the mechanism.
Figure 8:
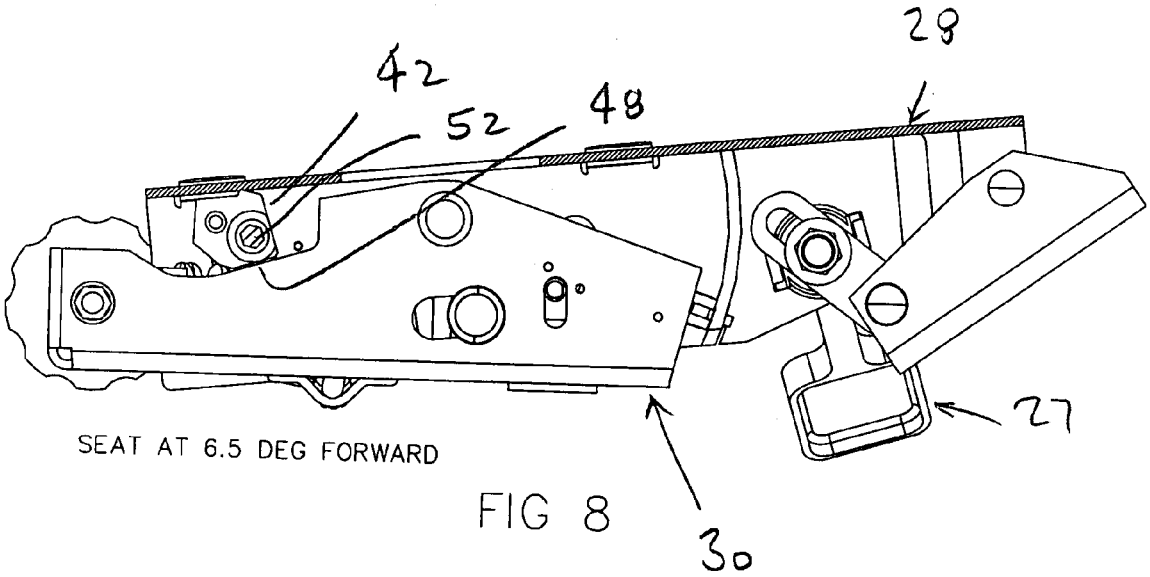
Figure 9:
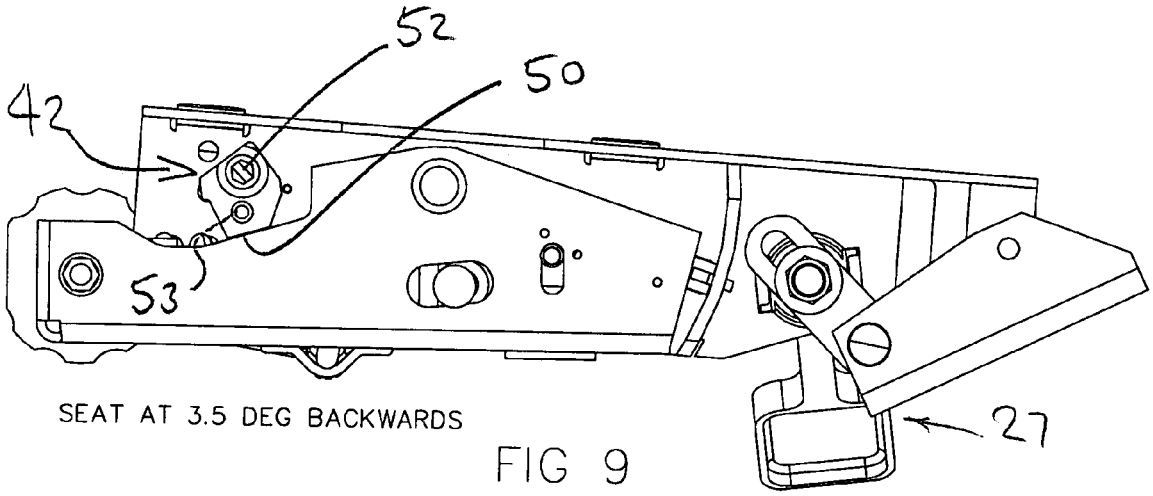

FIGS. 1, 1*a* and 2 also show a rotary stop 42 that is carried by the upper housing part and that bears against a surface 44 on the lower housing part to define the rest position of the two housing parts with respect to one another. This stop is a component of the three-position tilt stop mechanism of the invention and is illustrated in more detail in FIGS. 6 to 9. Stop 42 is shown in each of FIGS. 7, 8 and 9 but in respectively different angular positions corresponding to different stop positions of the housing parts. For example, in FIG. 7 the stop position is designated at 1.5 degrees forward tilt, in FIG. 8 as 6.5 degrees forward tilt and in FIG. 9 as 3.5 degrees backward tilt. In this embodiment, the stop 42 has three stop surfaces 46, 48 and 50 shown respectively in FIGS. 7, 8 and 9 in their "operative" rest position-defining orientations. Of course, there is no limitation to three surfaces only. The surfaces 46, 48 and 50 are at respectively different radial distances from an axis 52 about which the stop is turnable.

Figure 6A:
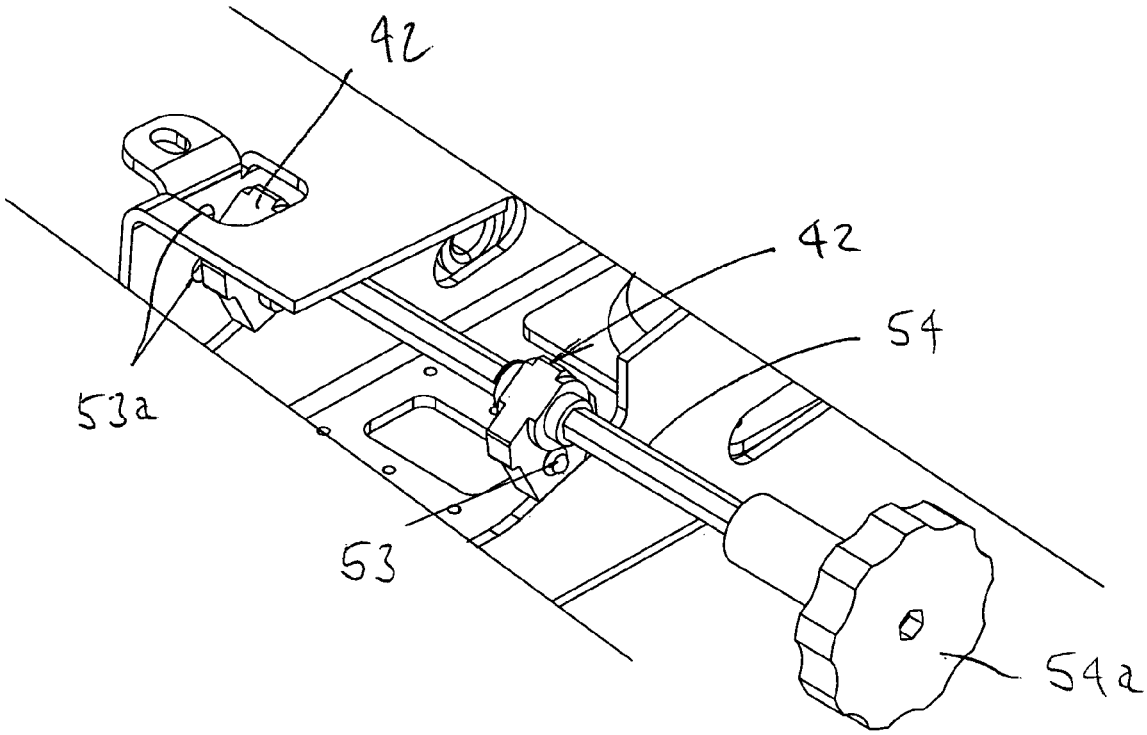
FIG. 6A is a detail perspective view of part of FIG. 6.

FIG. 6A shows a plunger 53, in the form of a spring loaded steel ball, that is provided on each stop 42 for engagement in one of three detents 53*a* in the adjacent sidewall of the lower housing part 30 for defining the three angular positions of the stops.

Axis 52 is defined by a transverse shaft 54 shown in FIG. 6. Shaft 54 carries a second rotary stop similar to stop 42 at the far side of the lower housing part in FIG. 6. The second stop is identical with stop 42 and is in the same angular position about the shaft. The second stop co-operates with a surface portion of the lower housing part corresponding to surface 44, so that the upper housing part is supported equally at both sides. Shaft 54 also projects laterally from the mechanism so as to extend below the seat of a chair in which the mechanism is installed and be conveniently accessible to a person seated in the chair. Again, a handle or knob 54*a* is provided so that shaft 54 can be turned easily.

Figure 10:
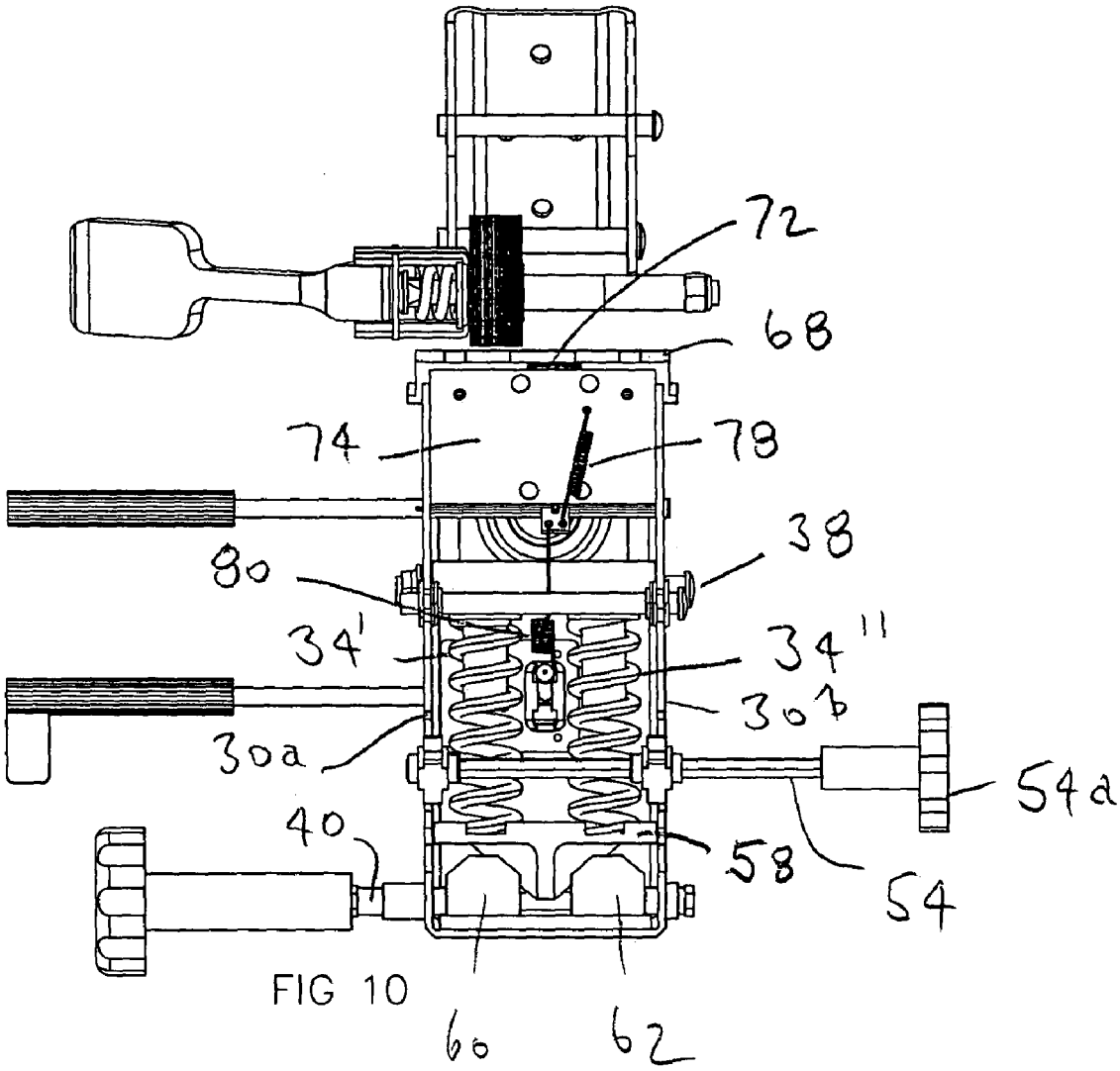
FIG. 10 is a view similar to FIG. 4 illustrating a slightly modified embodiment of the invention in which a pair of parallel tension control springs are used instead of a single spring.

The tilt mechanism of the invention may have only a single compression spring 34. However, the drawings in fact show an embodiment in which a pair of compression springs denoted 34' and 34" are used side-by-side. The upper ends of the springs 34', 34" as seen in FIG. 10 bear against a pair of cylindrical blocks 56 that form spring seats. The blocks are carried by a tube 57 through which pin 38 extends (see FIG. 13). The lower ends of the springs as seen in FIG. 10 bear against a top surface of a wedge element 58 that is moveable towards and away from pin 38 to control the tension in the springs 34', 34" and hence the degree of cushioning that is encountered when a person seated on the chair leans back. Element 58 provides respective spring seats for the lower ends of springs 34', 34".

Tension adjustment is accomplished by a sliding wedge arrangement that is perhaps best seen in FIGS. 11 and 12. The mechanism essentially comprises wedge element 58 and a pair of co-operating wedge elements 60, 62 that are adjustable laterally of the mechanism towards and away from one another by turning the shaft 40 that projects laterally from the mechanism below the seat of the chair. Shaft 40 extends through bushings in the side walls 30*a* and 30*b* of the lower housing part 30. Between those side walls, the shaft extends through aligned plain bores in the respective wedge elements 60, 62. The external surface of the shaft is screw-threaded and carries a nut 63 received in a slot in the bottom of wedge element 62. A corresponding slot 64 in wedge element 60 is empty. A shoulder 40*b* on shaft 40 bears against the outer face of wedge element 60. Turning shaft 40 in one rotational direction moves the wedge elements 60, 62 towards one another by virtue of shoulder 40*b* moving wedge element 60 to the right in FIGS. 11 and 12 and nut 63 drawing element 62 to the left.

Wedge element 58 is located between the two wedge elements 60, 62 and the springs 34', 34" of the tension control mechanism bear against element 58. Wedge element 58 is symmetrical about a longitudinal centerline of the chair control mechanism and has a pair of inclined faces 58*a*, 58*b* that bear against corresponding parallel faces of wedge element 60, 62. Those faces are in fact formed by channel-shaped grooves in the respective wedge elements and the wedge element 58 is received between opposite faces of those grooves so that the wedge elements are positively located with respect to one another in the vertical direction.

It will of course be appreciated that, if the shaft 40 is turned in the appropriate rotational direction to move the wedge elements 60, 62 towards one another, wedge element 64 will be forced upwardly in FIG. 11, compressing the springs 34', 34". Turning of shaft 40 in the opposite rotational direction will allow the wedge elements 60, 62 to move apart under the influence of in the springs 34', 34", as those springs relax.

The mechanism is designed so that, when the wedge elements 60, 62 are at the maximum spacing as shown in FIG. 11, there is no tension in the springs 34', 34". In fact, the mechanism is designed so that there is a slight clearance c (FIG. 11) between the springs (shown in exploded positions at S in FIG. 11) and the spring seats at opposite ends of the springs, when the wedge elements 60, 62 are fully spaced apart and the springs are fully relaxed. This greatly facilitates assembly of the mechanism in that the springs can be simply dropped into place without any need for pre-compression or forcing the springs into place.

The mechanism can easily be hand assembled by positioning the wedge elements 60, 62 at their full outward spacing against respective sidewalls 30*b*, 30*c* of the lower house part and without the shaft 40 in place. The shaft is then inserted through the aligned openings in the sidewalls of the housing part and bores in the wedge elements and is fitted at its distal end with a retaining collar 66, after the springs have been placed into the mechanism. The shaft can then be turned to move the wedge elements towards one another and apply some compression to the springs 34', 34".

Collar 66 is screw threaded onto shaft 40 and has a hexagonal outer surface so that it can be adjusted on the shaft to apply any desired pre-load to springs 34', 34". The collar is then secured to the shaft by adhesive (e.g. LOCTITE™).

In summary, the particular tension adjustment mechanism provided in accordance with the invention is both easy to assemble without the need for any special tools or spring tensioning, and also provides for convenient tension adjustment by a person seated on the chair, who merely has to reach down and turn the shaft 40 until a comfortable tension level is achieved.

Figure 13:
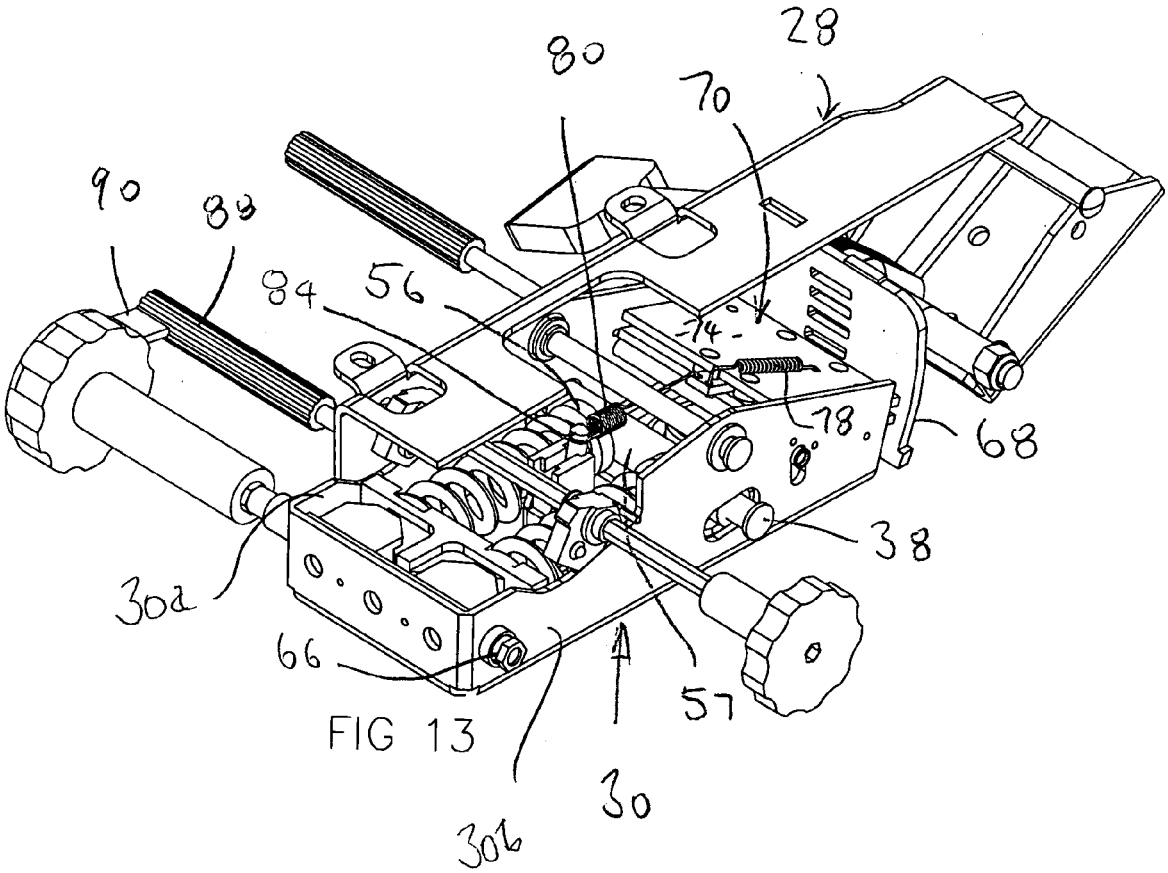
FIG. 13 is a perspective view of the control mechanism illustrating the anti kick-back feature; and, FIG. 14 is a fragmentary cross-sectional view of the tongue and rack arrangement.
Figure 14:
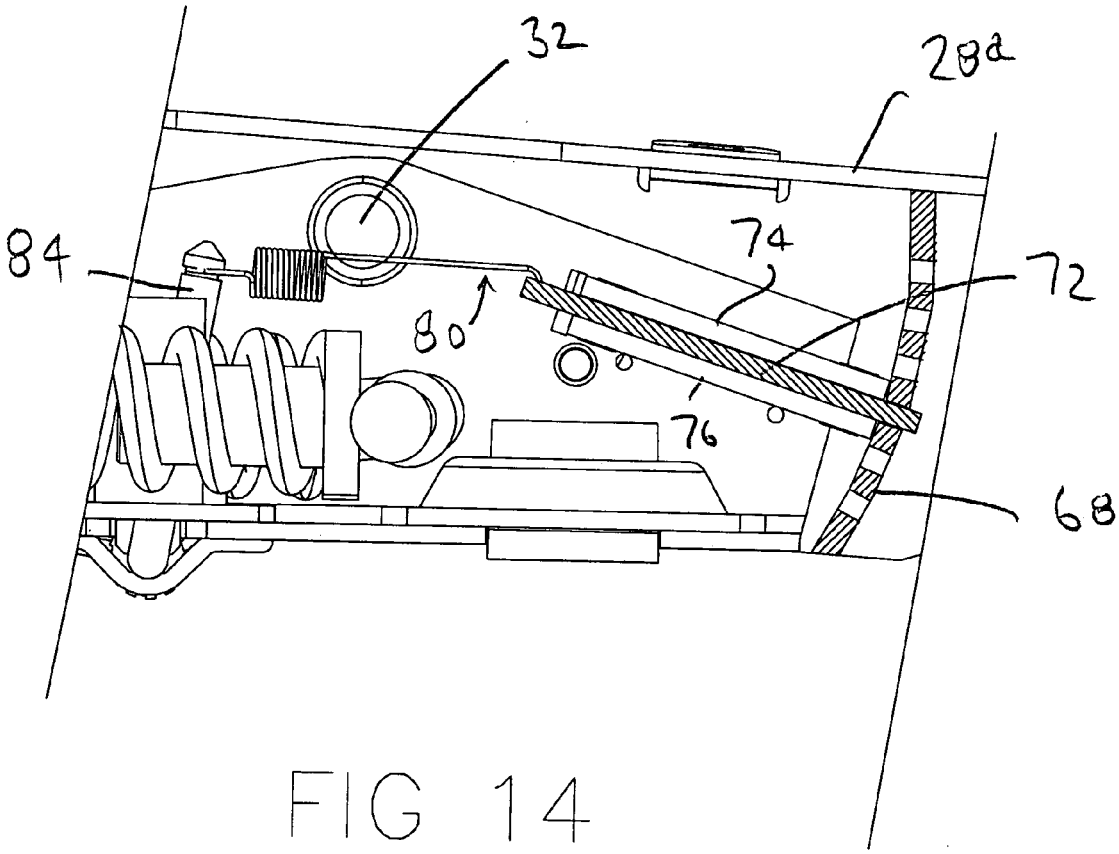

Reference will finally be made to FIGS. 13 and 14 in describing the anti kick-back feature of the chair control. As best seen in FIG. 14, a curved rack element 68 extends downwardly from a top wall 28*a* of the upper housing part 28. As the upper housing part tilts with respect to the lower housing part 30 when a person leans back in the chair, the rack 68 moves in an arcuate path with respect to the lower housing part. In fact, the rack 68 is curved to follow a radius centered on the pivot pin 32 between the two housing parts. A slide 70 carried by the lower housing part includes a tongue 72 that can be retracted to allow free movement of the rack 68 with respect to the slide, or projected into a selected one of the teeth of the rack to lock the two housing parts in respective angular positions. In FIG. 13, the tongue 72 is shown in a projected position in engagement with one of the teeth of the rack.

Tongue 72 is slideably mounted between upper and lower plates 74, 76 of slide 70 so that the tongue moves generally on a radial line centered on pivot shaft 72. A tension spring 78 extends between the tongue 72 and the top plate 74 so that the spring is in tension (i.e. stretched) for urging the tongue 72 to the locking position in which it is shown in FIG. 13. As best seen in FIG. 14, spring 78 is a simple coil spring having hooked portions at its respective ends that are engaged in openings in the top plate 74 and in a projecting end portion of the tongue 72. The tongue can be retracted against the biasing effect of spring 78 by a further spring 80 (FIG. 13). A hooked portion at one end of spring 80 is engaged in an opening in tongue 72 while an "eye" formation at the opposite end of the tension element extends around a vertical limb 84 of an L-shaped actuating member. The member has a horizontal limb that extends laterally of the chair control and projects outwardly to one side thereof as shown at 88 in FIG. 4. A paddle 90 on limb 88 allows limb 88 to be turned angularly, moving the vertical limb 84 of the member back and forth generally on the longitudinal centerline of the chair control. As best seen in FIG. 11, limb 86 extends between a pair of resilient jaws 92 having detent positions 94, 96 at opposite ends, in either of which the limb is retained in an extreme end position. In other words, by depressing or lifting the paddle 90 at the outer end of the horizontal limb 88, the vertical limb 86 can be caused to "snap" between extreme end positions to project or retract the tongue 72.

As mentioned previously, the tongue and rack arrangement just described provides a so-called anti kick-back feature that prevents release of the chair control in such a way as to allow uncontrolled return of the housing parts to their rest position under the effect of the compression springs 34', 34". Thus, if the chair control has been set at a particular tilt by engaging the tongue 72 in an appropriate one of the teeth of the rack 68, the compression springs 34', 34", acting between the upper and lower housing parts 28, 30 respectively cause the tongue 72 to bind in the rack so that the tongue and rack will remain engaged even if the paddle 90 is moved in a direction to retract the tongue. Retraction can take place only when the user of the chair leans back against the force of the compression springs so that the tongue 72 no longer binds in the rack and is free to retract. Since the user is seated in the chair at this time and is pushing back on the chair back, the user's body effectively controls return movement of the housing parts under the effect of the compression springs and there is no "kick" or uncontrolled movement.

It will of course be understood that the preceding description applies to particular preferred embodiments of the invention and that many modifications are possible within the broad scope of the invention. For example, the aspects of the invention described previously may be embodied in a single tilt mechanism, but are not necessary used together. Referring in particular to the anti kick-back feature, it is of course to be understood that other or different linkages or mechanisms can be used to retract the tongue 72 and that the particular mechanism shown is not essential.

The invention claimed is:

1. A tilt mechanism for a chair comprising:

upper and lower housing parts adapted to be coupled respectively to a chair seat/back assembly and to a chair base, said parts being pivoted together for movement with respect to one another about a pivot axis to permit tilting of the seat/back assembly with respect to the base in use;

a compression spring extending between respective spring seats carried by said upper and lower housing parts so as to normally maintain said parts in a rest position, while being compressed when the upper housing part tilts with respect to the lower housing part in use; and, a spring tension control including wedge means between one of said spring seats and the associated housing part, said wedge means including a first wedge component coupled to one of said spring seats and said associated housing part and a pair of second wedge components co-operating with said first wedge component, said second wedge components being supported for lateral displacement towards and away from one another, the respective wedge components having co-operating sliding surfaces angled so that displacement of the second wedge components towards one another compresses the spring, increasing spring tension, while displacement of said moveable components away from one another allows the spring to relax, reducing spring tension, said second wedge components having a position of maximum spacing from one another in which the spring is fully relaxed and the overall length of the spring is less than the spacing between said spring seats for facilitating installation or removal of the spring; and an operator controlled actuator for effecting said displacement of the second wedge components towards and away from one another.

2. A tilt mechanism as claimed in claim 1, further comprising:

stop means disposed between said upper and lower housing parts and defining said rest position of those parts, said stop means having a plurality of stop surfaces and being moveable to bring different ones of said surfaces selectively into an operative position between the housing parts, said stop surfaces defining respectively different angular positions of the housing parts with respect to one another; and, an operator controlled actuator for moving said stop means.

3. A tilt mechanism as claimed in claim 2, wherein the stop means comprises a rotary stop with stop surfaces at different radial positions with respect to an axis about which the stop can be turned.

4. A tilt mechanism as claimed in claim 3, wherein said rotary stop comprises a rotary shaft that extends transversely of the upper and lower housing parts and a pair of rotary cam-like structures carried by the shaft and disposed one at each side of the tilt mechanism, the shaft projecting laterally of the mechanism for turning the cam-like structures, the shaft comprising said operator controlled actuator.

5. A tilt mechanism as claimed in claim 4, wherein the shaft is carried by the upper housing part and the cam-like structures rest on respective stop surfaces on the lower part.

6. A tilt mechanism as claimed in claim 1, wherein a second said compression spring is provided, the two springs being substantially identical and extending parallel to one another between the respective spring seats.

7. A tilt mechanism as claimed in claim 1, wherein said spring tension control extends between an end wall of the lower housing part and said one spring seat, the first wedge component being coupled to said one spring seat.

8. A tilt mechanism as claimed in claim 7, wherein said co-operating sliding surfaces each comprise a groove in one said surface having side walls between which the other co-operating sliding surfaces received.

9. A tilt mechanism as claimed in claim 1, further comprising:

anti kick-back control means comprising a tongue carried by one of said housing parts and a rack carried by the other of said housing parts and having a plurality of teeth for receiving the tongue, the rack and tongue moving relative to one another as the housing parts pivot with respect to one another so that the tongue can engage different ones of said teeth corresponding to a series of different tilt positions of the housing parts with respect to one another, the rack being curved about said pivot axis; a slide supporting said tongue for longitudinal sliding movement between extended and retracted positions with respect to said rack, a tension spring connected between said tongue and slide, the tension spring being stretched for biasing said tongue to its extended position, and a tension member for retracting said tongue under operator control against the bias of the tension spring to permit said tilt position to be changed;

said compression spring providing a biasing force between said housing parts that causes the tongue to bind in the rack and prevent retraction of the tongue until a force counter to the biasing force is applied between the housing parts.

10. A tilt mechanism as claimed in claim 9, wherein the tension member extends between said tongue and an actuating member that is moveable towards and away from the rack for moving the tongue between its extended and retracted positions and wherein the tilt mechanism further comprises a pair of resilient jaws engaging said actuating member and defining respective detent positions for the actuating member corresponding to said extended and retracted positions of the tongue.

* * * * *